US011628116B2

(12) United States Patent
Sosa

(10) Patent No.: US 11,628,116 B2
(45) Date of Patent: Apr. 18, 2023

(54) PORTABLE MODULAR STRETCHING SYSTEM

(71) Applicant: Ricardo Sosa, Miami, FL (US)

(72) Inventor: Ricardo Sosa, Miami, FL (US)

( * ) Notice: Subject to any disclaimer, the term of this patent is extended or adjusted under 35 U.S.C. 154(b) by 332 days.

(21) Appl. No.: 16/813,726

(22) Filed: Mar. 9, 2020

(65) Prior Publication Data

US 2020/0281795 A1 Sep. 10, 2020

Related U.S. Application Data

(60) Provisional application No. 62/815,157, filed on Mar. 7, 2019.

(51) Int. Cl.
*A61H 1/02* (2006.01)

(52) U.S. Cl.
CPC ... *A61H 1/0244* (2013.01); *A61H 2001/0248* (2013.01); *A61H 2201/0107* (2013.01); *A61H 2201/0157* (2013.01); *A61H 2201/0192* (2013.01); *A61H 2201/1253* (2013.01); *A61H 2201/149* (2013.01); *A61H 2201/1642* (2013.01)

(58) Field of Classification Search
CPC .. A61H 1/0244; A61H 1/0266; A61H 1/0248; A61H 2201/0107; A61H 2201/0248; A61H 2205/10; H61H 2201/1253
USPC ..... 482/146, 131
See application file for complete search history.

(56) References Cited

U.S. PATENT DOCUMENTS

| | | | | |
|---|---|---|---|---|
| 4,647,040 | A * | 3/1987 | Ehrenfried | A61H 1/02 482/131 |
| 4,844,453 | A * | 7/1989 | Hestilow | A61H 1/0244 482/131 |
| 6,398,699 | B1 * | 6/2002 | Yang | A63B 22/14 482/52 |
| 6,821,231 | B1 * | 11/2004 | Hall | A63B 23/0429 482/142 |
| 10,172,758 | B1 * | 1/2019 | Downs | A61H 1/0237 |
| 2004/0060107 | A1 * | 4/2004 | Eisenberg | A47K 7/046 4/605 |
| 2014/0190289 | A1 * | 7/2014 | Zhu | B62D 57/02 74/89.22 |
| 2016/0256344 | A1 * | 9/2016 | Lee | A63B 23/0488 |
| 2018/0290016 | A1 * | 10/2018 | Smith | A63B 21/4034 |

* cited by examiner

*Primary Examiner* — Samchuan C Yao
*Assistant Examiner* — Nathan M Le
(74) *Attorney, Agent, or Firm* — Diana Mederos

(57) ABSTRACT

A portable modular stretching apparatus has a basic structure of a base, central rod, pulley, cable system, and two legs jointed at the central rod and alongside the base. Attachments are then added for customized stretching. Attachments provide for hamstring, hips, quadriceps, knees, gastrocnemius, ankle, and metatarsal stretching, limberness, and extension, and hyperflexion. A person adds and removes the attachments based on the desired stretch routine, controls the tension, and removes the attachments, and folds the apparatus when complete.

14 Claims, 8 Drawing Sheets

Fig. 7A
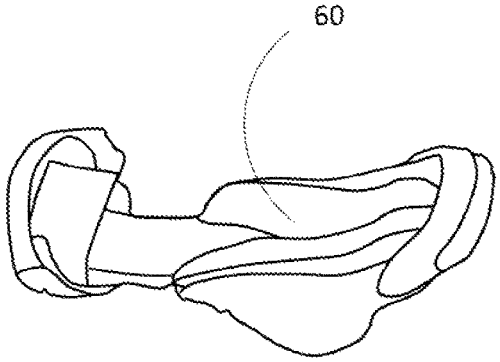
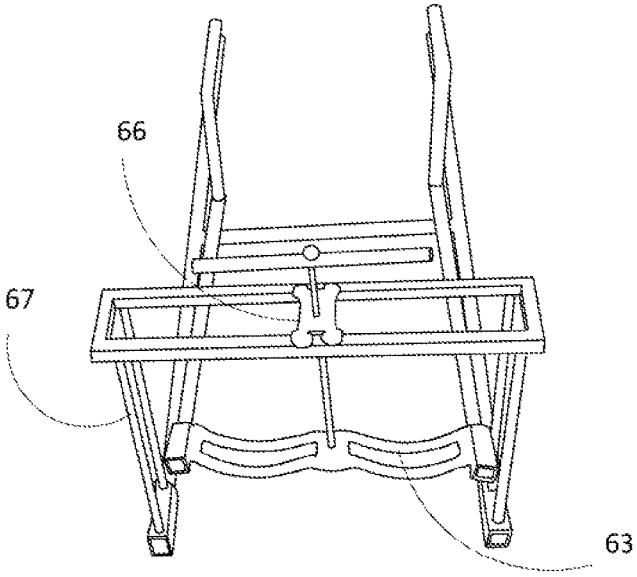
Fig. 7B
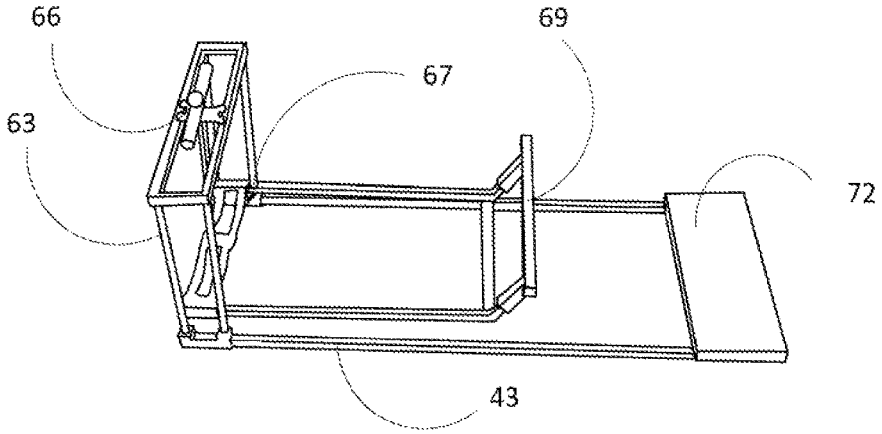
Fig. 7C

Fig. 8A
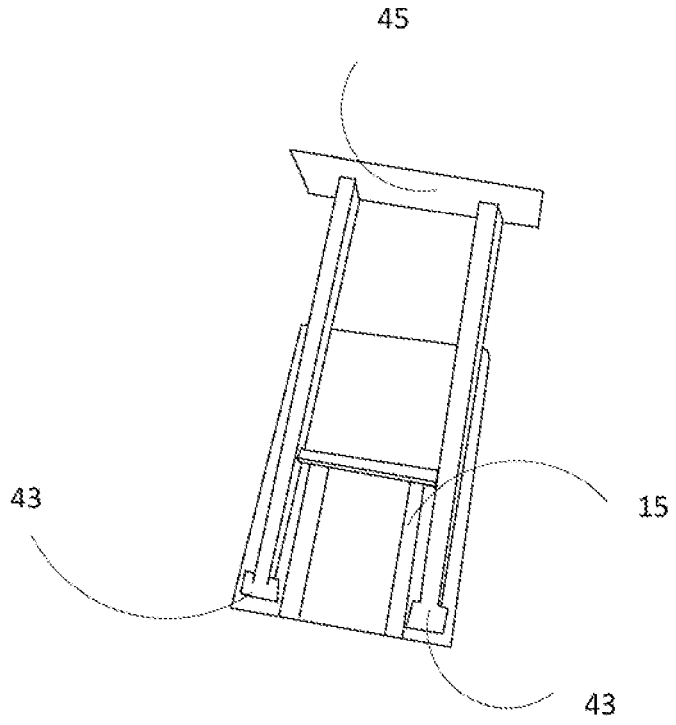
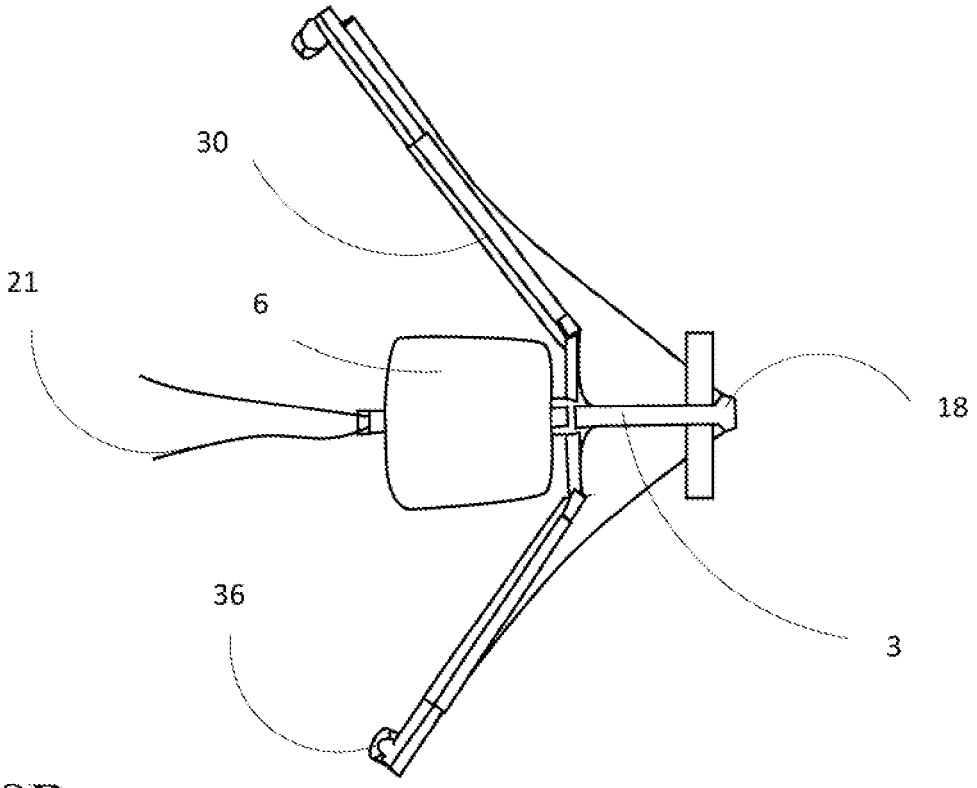
Fig. 8B

PORTABLE MODULAR STRETCHING SYSTEM

PRIORITY CLAIM

This application claims the benefit of U.S. provisional application No. 62/815,157, entitled Sosa Stretch and having a filing date of Mar. 7, 2019. The contents of U.S. provisional application No. 62/815,157 are incorporated by reference.

FIELD OF THE DISCLOSURE

The present disclosure relates to a multi-component stretching apparatus having folding capabilities and interchangeable attachments. The portable modular stretching apparatus offers a lightweight and customizable solution for stretching exercises for those looking to maintain general limberness or to increase hyper flexibility for contortionists. Stretching exercises can be done in a seated or standing position.

BACKGROUND OF THE DISCLOSURE

Contortionists, gymnasts, and dancers, like other athletes, need to warm up, stretch, and maintain limberness regularly to stay in shape, maintain the ability to perform as required, and to minimize injury. However, unlike most athletes, contortionists, gymnasts, and dancers often require extreme form of controlled stretching with gradual progression and slow releases and in extreme positions and hyperflexion. Many contortionists, gymnasts, and dancers also perform or compete on tour. While on tour, consistency is important to reduce and prevent injuries.

Traditionally, extreme stretching would be accomplished through the use of stationary machinery or along with the help of a colleague. Other traditional stretching devices include the use of bands and yoga blocks. However, most stretching machinery is not consistently available and too costly and bulky to transport while on tour. Resistance bands and yoga blocks do not reduce the risk of injury because stretching progression and gradual release are not controlled. Traditional stretching methods also do not help in improving limberness and flexibility required for body contortion which requires excessive hip, waist, back, leg, knee, ankle, and foot flexibility. Traditional stretching methods and apparatuses also provide poor alignment and poor ability to promote progressive increases in intensity and tension rather than incremental increases.

SUMMARY OF THE DISCLOSURE

What is needed is the portable modular stretching system of the disclosure. The stretching system comprises the core components of a pully attached at one end of a central rod. The central rod is connected to a base. The central rod has a joint on either side of the base. A leg is attached at each joint. Cable is threaded through the central rod or along the legs. A bottom platform can be attached to the base, and a back platform can be attached to the central rod for seated stretches. A person pulls on the cable to create tension for progressively difficult and challenging stretching of the back, hips, and leg muscles such as the hamstrings, quadriceps, and gastrocnemius.

In one embodiment, the stretching system attachments are attached at the central rod, at the back platform attachment receptacles, and at the leg attachment receptacles. The legs have wheels to allow for movement to the front and sides along an x axis.

In one embodiment, the stretching system attachments are removed, and the legs are folded in towards a center and upward along a y axis. The telescopic legs are minimized. The legs can be locked in place with a fastener threaded through a hole at the end of each leg. The folded apparatus is placed in a carry case or backpack. The carry case or backpack can accommodate the attachments.

Attachments provide for enhanced flexion of the knees, ankles, feet, and hips. Attachments include a swivel base attachment and a back platform handlebar attachment for waist and hip stretching while standing. Attachments include a foot cradle with a crank to increase tension to promote metatarsal, ankle, lower leg, and arch flexion and extension and extension while performing other lower body stretches. Attachments for lower leg stretching include a leg cradle that moves along a track and adjusted up and down by a screw crank. Some lower leg stretching attachments include a waist bar and a platform to enhance alignment and increase stretching difficulty.

BRIEF DESCRIPTION OF THE DRAWINGS

The accompanying drawings that are incorporated in and constitute a part of this specification illustrate several embodiments of the disclosure and together with the description serve to explain the principles of the disclosure.

FIG. 7A shows an exemplary foot cradle attachment.

FIG. 7B shows a front view of an exemplary leg stretching attachment.

FIG. 7C shows a side view of an exemplary leg stretching attachment with platform and waist bar.

FIG. 8A shows a rear perspective view of an exemplary back platform attachment with handlebars.

FIG. 8B shows a top side view of an exemplary apparatus without a back platform and without a bottom platform.

REFERENCE NUMERALS OF THE DRAWINGS

Figure 1:
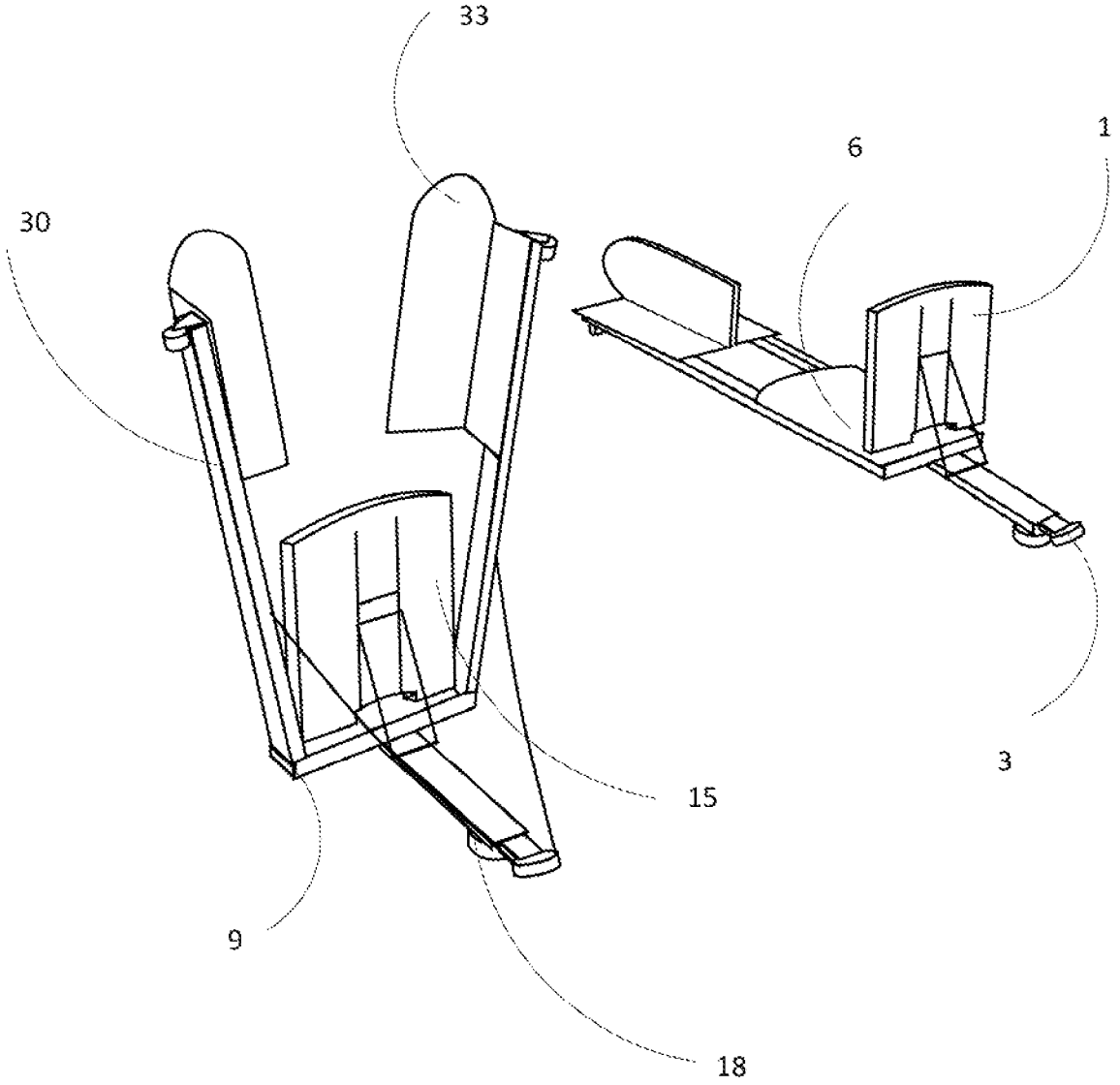
FIG. 1 shows a rear perspective view of an exemplary stretching apparatus.

1. Apparatus
3. Central rod
6. base
9. joint
12. Attachment receptacle
15. Back platform
18. pulley
21. cable
24. Tension crank

27. Bottom platform
30. leg
33. wing
36. wheel
39. Carry case
42. Back platform attachment receptacle
43. Attachment appendage
44. Back platform attachment
45. Handlebars
46. Lower leg stretch attachment
48. Swivel platform
51. Cable ring
54. Leg distal end
57. Back platform support
60. Foot cradle
63. Leg cradle
66. Hand crank
67. track
69. Waist bar
72. Platform

DETAILED DESCRIPTION

The present disclosure provides generally for a portable modular stretching apparatus. The stretching apparatus is especially useful for traveling athletes and performers. The system was specifically inspired by the often-extreme stretching needs of contortionists and circus performers. The system provides users with the ability to progressively increase the intensity and difficulty of various lower body stretches. In preferred embodiments, the stretch tension, intensity, and difficulty, are self-directed and manually controlled with hand cranks and screw cranks and direct pulling on cables threaded through the hollow central rod and leg cores.

The system in interchangeable with attachments designed to fit into attachment receptacles present at the distal ends of each leg and at the rear side of the back platform and on top of the base. Multiple attachments can be used at the same time. For example, a person can use a lower leg stretching attachment and a foot cradle stretching attachment at the same time to elongate the legs and pointed foot at the same time.

The attachments can be removed, and the telescopic legs contracted and folded toward the base and central rod. The central rod serves as the main chassis and can be in a linear, T, or cross shape. The legs can be folded and can move upward along a y axis. The legs can move outward and inward along an x axis. The legs can have wheels attached to facilitate a gliding movement about a surface. The legs can be locked together by threading a fastener through corresponding holes at the distal ends of the legs.

In preferred embodiments, a portable modular stretching apparatus comprises a central rod connected to a base at the center, a joint on each end of the central rod, a telescopic leg attached at each joint, and attachment receptacle at the central rod to accommodate a back platform, a pulley with a cable and tension crank attached to the central rod, and wherein the base at the center is capable of accommodating a bottom platform attachment fixedly or removably attached to the base. A cable and pulley system and hand crank and screw crank systems are implemented to manually control the progressively difficult stretching with increased tension. The alignment structures such as leg and foot cradles and leg wings promote alignment and stability. The combination of the manually controlled pulley and cranks along with the supportive structures promotes stability and alignment to minimize the risk of injury, abrupt movement, and muscle spasms.

A person can use the system seated or standing. For example, while seated, a user can place his legs along the apparatus legs and held with the wings. Cables can be threaded through the hollow legs and pulled to increase tension outward along an x axis or upward along a y axis.

In another seated stretching position, leg stretching attachments are attached to the receptacles at the end of the distally forward positioned legs. The user's lower legs are placed in a cradle. A screw crank adjusts the movement of the cradle up and down, stretching out the legs.

In a standing stretching position, a back platform attachment is attached at the back platform attachment receptacle where the attachment's corresponding attachment appendages are placed. The back platform attachment has handlebars at the top. The base has a swivel platform attached. A person stands on the swivel platform, holds onto the handlebars, and twists the lower body at the waist while keeping the torso and upper body straight.

As used herein, a fastener is any apparatus that can hold multiple parts together. As used herein a cable, is any rope, string, band, twine, or cord.

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

Referring now to FIG. 1, a rear perspective view of an exemplary stretching apparatus is shown with the legs upward along a y axis and the legs positioned together in front. A base, a pulley with cable, joints, legs, bottom platform, back platform, and back platform support are shown in an exemplary configuration. In preferred embodiments, the joints are ball-and-socket joints, but other joint types are contemplated. In the exemplary embodiment, the legs are shown with optional wings for a user's leg alignment.

Figure 2:
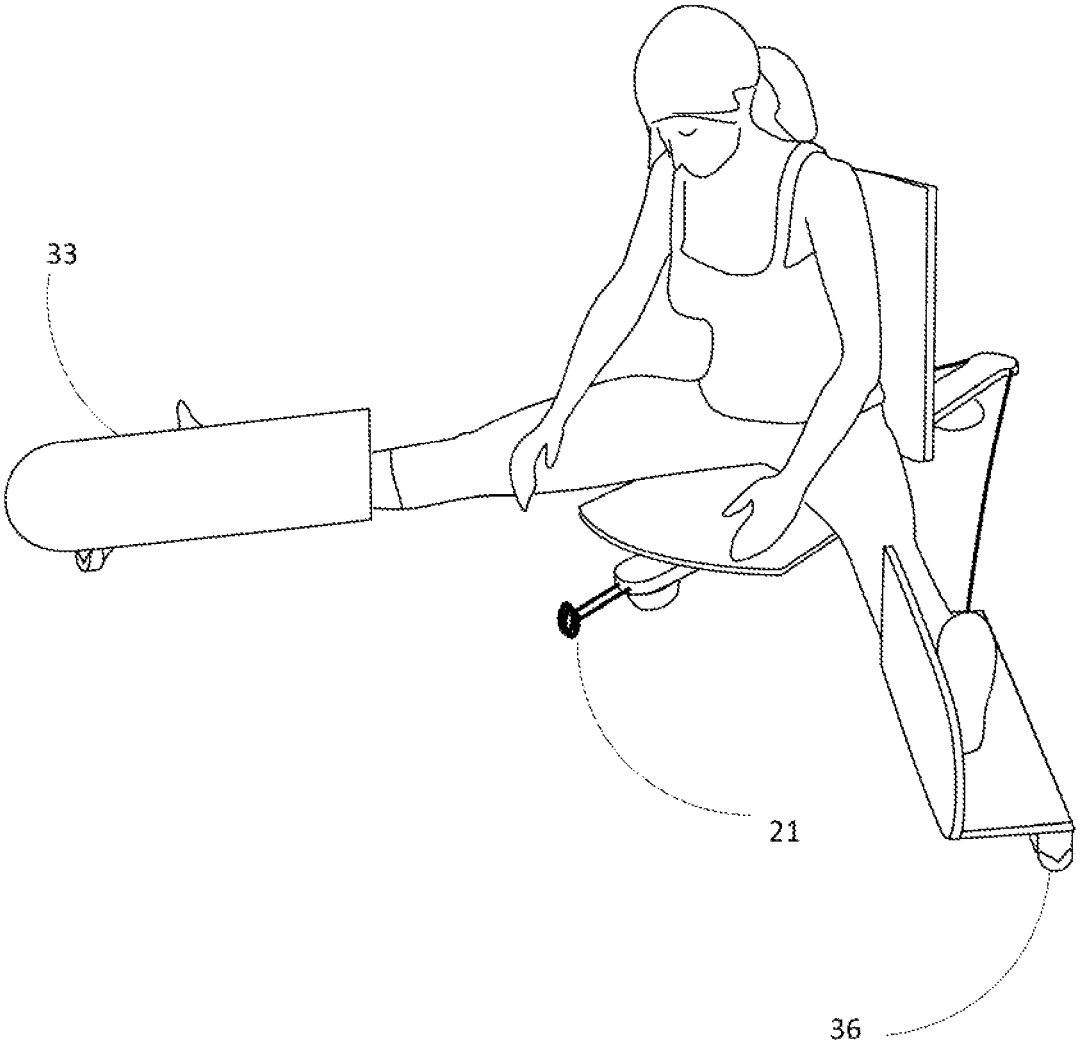
FIG. 2 shows a front perspective view of a person using an exemplary stretching apparatus.

Referring now to FIG. 2, a front perspective view of a person using an exemplary stretching apparatus is shown. In this exemplary embodiment, the structures as shown in FIG. 1 are replicated to provide a different viewpoint. In the front center, the cables are shown as being threaded through the hollow central rod. A user is performing a seated stretch of the legs and can control the tension by manually pulling on the cable to move the legs outward away from the center so as to do a split.

Figure 3A:
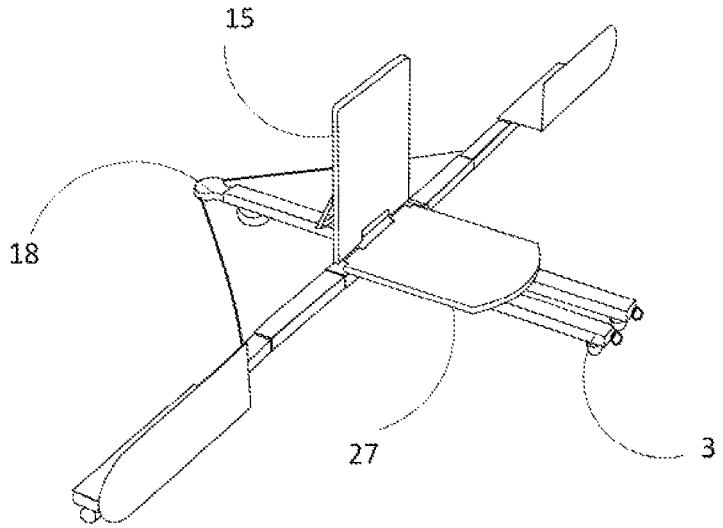
FIG. 3A shows a front perspective view of an exemplary stretching apparatus with legs spread at a 180-degree angle.
Figure 3B:
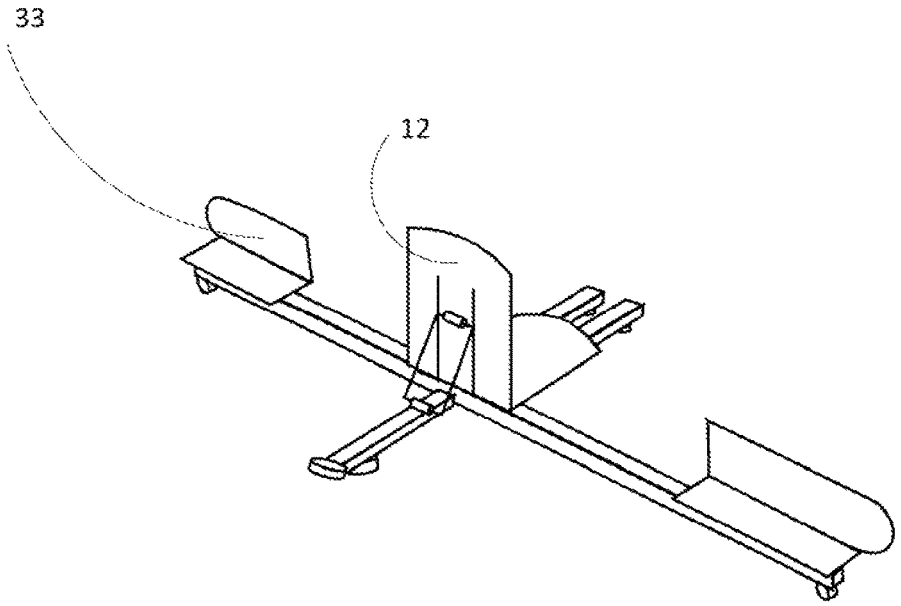
FIG. 3B shows a rear perspective view of an exemplary stretching apparatus with legs spread at a 180-degree angle.

Referring now to FIGS. 3A and 3B, a front perspective view and a rear perspective view of an exemplary stretching apparatus with legs spread at a 180-degree angle are shown. The exemplary apparatus is shown with alternative viewpoints as in FIGS. 1 and 2. In this exemplary embodiment, the central rod is in a linear shape with two openings in the front center.

Figure 4:
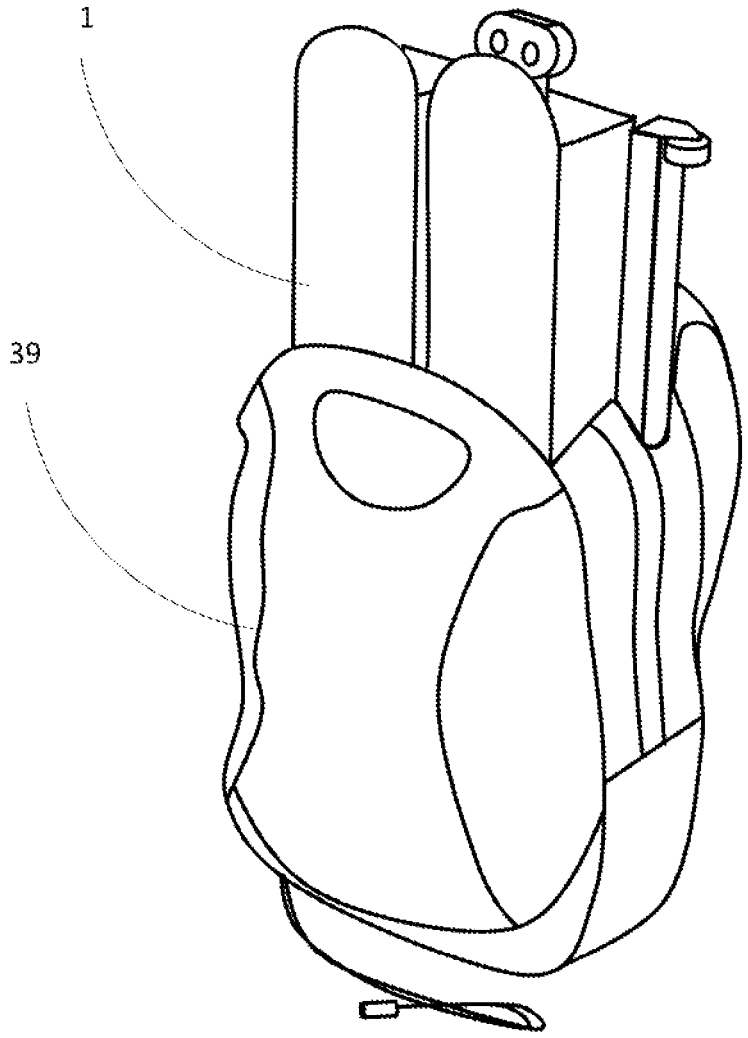
FIG. 4 shows a perspective view of an exemplary stretching apparatus in a folded position and stored in a carry case.

Referring now to FIG. 4, a perspective view of an exemplary stretching apparatus in a folded position and stored in a carry case is shown. In this exemplary embodiment, the attachments have been removed from the apparatus. The telescopic legs have been compressed and folded toward the center. The folded apparatus has been placed in a carry case. In this example, the carry case is an open-top or semi-closed backpack. Other carry cases such as luggage and duffel bags are also contemplated.

Figure 5:
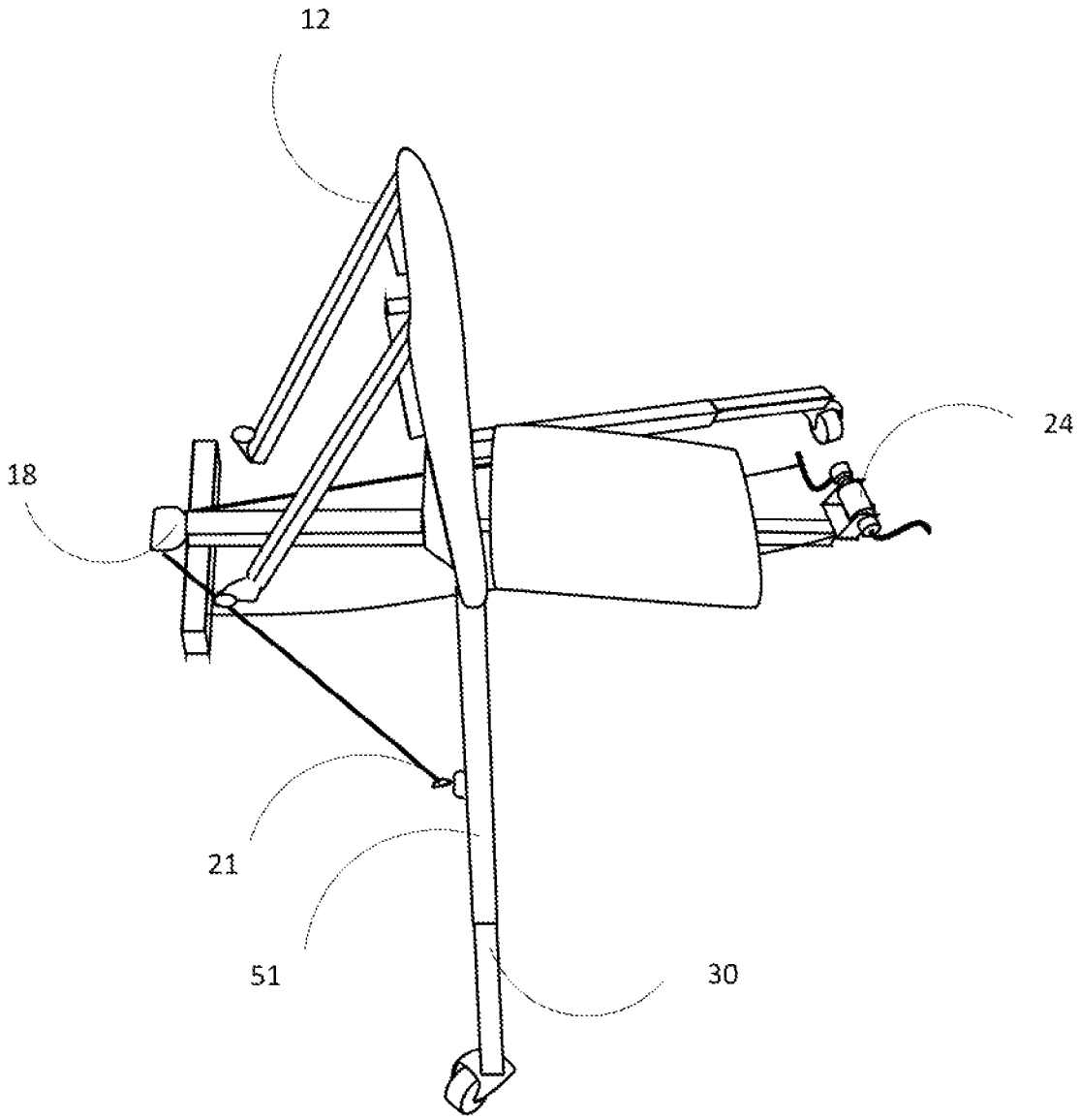
FIG. 5 shows a top side view of an exemplary stretching apparatus with hand crank, cable, back platform, and bottom platform attachments.

Referring now to FIG. 5, a top side view of an exemplary stretching apparatus with hand crank, cable, back platform, and bottom platform attachments is shown. In this example, the apparatus shows one leg positioned toward the center and one leg positioned outward. A tension crank is shown in the center. When a user activates the tension crank, the cable is reeled in or out, tightening or loosening the cable and consequently moving the legs accordingly.

A user can customize the movement, tension, and range of movement as seen here by adjusting the way the cable is threaded. In this example, the cable is threaded through the cable rings on a single leg rather than on both legs. Therefore, when the tension crank is activated, only the leg with the cable threaded through the cable rings will move and stretch the user's leg.

Figure 6:
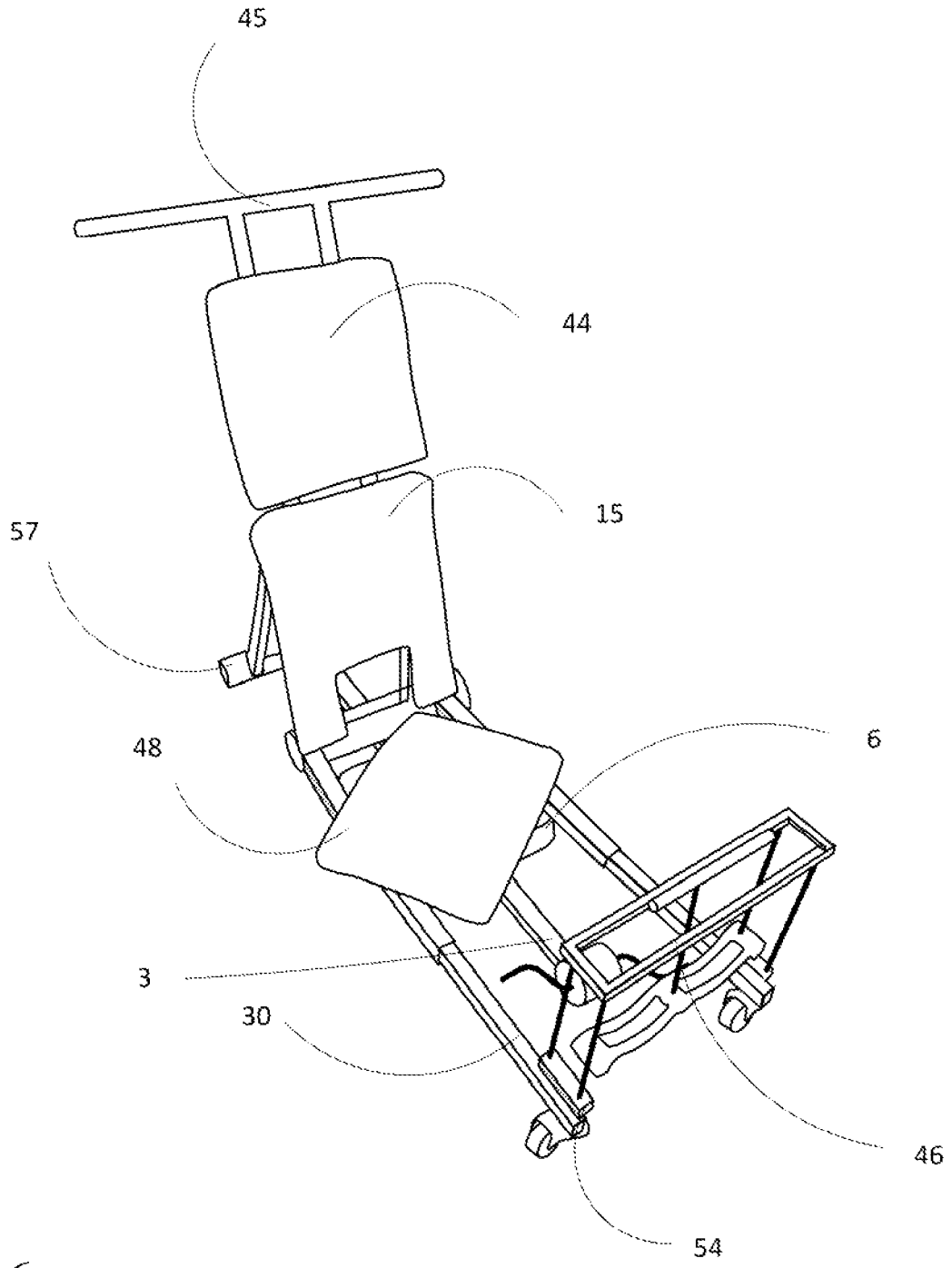
FIG. 6 shows a top perspective view of an exemplary stretching apparatus having a swivel bottom platform, back platform, upper body rail, and leg tension stretch attachments.

Referring now to FIG. 6, a top perspective view of an exemplary stretching apparatus having a swivel bottom platform, back platform, upper body rail, and leg tension stretch attachments is shown. A swivel platform, is attached or placed on the base. A back platform attachment is attached with handle bars. The legs are brought forward toward the center and at the sides of the base. A lower leg attachment is connected to the legs at the distal attachment receptacle.

Referring now to FIGS. 7A, 7B, and 7C, the following exemplary attachments are shown, respectively: a foot cradle, a leg stretching attachment, and a leg stretching attachment with waist bar and platform.

Referring now to FIGS. 8A and 8B, a rear perspective view of an exemplary back platform attachment with handlebars and a top side view of an exemplary apparatus without a back platform and without a bottom platform are shown, respectively.

CONCLUSION

A number of embodiments of the present disclosure have been described. While this specification contains many specific implementation details, these should not be construed as limitations on the scope of any disclosures or of what may be claimed but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable subcombination.

Thus, particular embodiments of the subject matter have been described. Other embodiments are within the scope of the following claims. In some cases, the actions recited in the claims can be performed in a different order and still achieve desirable results. Various modifications may be made without departing from the spirit and scope of the claimed disclosure.

What is claimed is:

1. A portable modular stretching apparatus, the apparatus comprising:

a central rod connected to a base at a center of the base;

a joint on each end in a horizontal direction of the central rod;

a telescopic leg attached at each joint;

an attachment receptacle at the central rod to accommodate a back platform;

a pulley with a cable and tension crank attached to the central rod;

wherein the central rod and each of the telescopic legs are hollow;

wherein the base at the center is capable of accommodating a bottom platform attachment fixedly or removably attached to the base; and wherein the cable is threaded through a cable ring of each of the telescopic legs;

a leg stretching attachment connected to each of the telescopic legs and locked in place with a fastener; and wherein the leg stretching attachment comprises a platform, a waist bar, and a leg cradle capable of being adjusted up and down on a track, wherein the up and down movement is controlled by turning a screw crank.

2. The apparatus of claim 1 further comprising a wheel at a distal end of each of the telescopic legs so that each of the telescopic legs can move outward along an x axis.

3. The apparatus of claim 1 wherein each of the telescopic legs can move upward along a y axis outward along an x axis.

4. The apparatus of claim 1 wherein each of the telescopic legs is placed in front of base, extending along each side of the base.

5. The apparatus of claim 1 further comprising at least one foot cradle attachment placed on a user's foot, wherein the leg stretching attachment and the at least one foot cradle simultaneously provide knee, ankle, and metatarsal hyperflexion.

6. The apparatus of claim 1 further comprising a swivel bottom attachment fixedly or removably attached to the base and a back platform attachment with handlebars attached to attachment receptacles on the rear side of the back platform.

7. The apparatus of claim 1 further comprising a carry case wherein the apparatus is minimized and folded and placed substantially inside the carry case.

8. The apparatus of claim 1 further comprising an alignment wing removably attached to at least one of the telescopic legs.

9. The apparatus of claim 1 further comprising a back platform support bar.

10. A method of using a portable modular stretching apparatus comprising:

a central rod connected to a base at the center of the base, a joint on each end in a horizontal direction of the central rod, a telescopic leg attached at each joint, and an attachment receptacle at the central rod to accommodate a back platform, a pulley with a cable and tension crank attached to the central rod, and wherein the central rod and each of the telescopic legs are hollow, wherein the cable is threaded through a cable ring of each of the telescopic legs, wherein the base at the center is capable of accommodating a bottom platform attachment fixedly or removably attached to the base, the method steps comprising:

extending the legs forward;

attaching a leg stretching attachment having a leg cradle, a platform, a waist bar, a track, and a screw crank at an end receptacle of each of the telescopic legs and locking in place with a fastener;

sitting on the bottom platform;

placing lower legs on the leg cradle; and turning the screw crank to move the leg cradle up and down.

11. The method steps of claim 10 further comprising placing a foot cradle attachment on a user's foot.

12. The method steps of claim 11 further comprising adjusting the tension of the foot cradle to promote foot and lower leg stretching for pointed toes.

13. The method steps of claim 10 further comprising progressively pulling or tightening the cable to increase tension and stretching.

14. The method-steps of claim 10 further comprising removing the leg stretching attachment, compacting the telescopic legs, folding the telescopic legs toward the base, and placing the apparatus in a carry case.

* * * * *